US010624464B2

(12) United States Patent
Shuaib

(10) Patent No.: US 10,624,464 B2
(45) Date of Patent: Apr. 21, 2020

(54) DOUBLE MATTRESS CONNECTING SYSTEM

(71) Applicant: Mohammed Shuaib, East Elmhurst, NY (US)

(72) Inventor: Mohammed Shuaib, East Elmhurst, NY (US)

( * ) Notice: Subject to any disclaimer, the term of this patent is extended or adjusted under 35 U.S.C. 154(b) by 0 days.

(21) Appl. No.: 16/508,383

(22) Filed: Jul. 11, 2019

(65) Prior Publication Data

US 2019/0328144 A1 Oct. 31, 2019

(51) Int. Cl.

| | |
|---|---|
| ***A47C 27/08*** | (2006.01) |
| ***A47C 21/02*** | (2006.01) |
| *A44B 17/00* | (2006.01) |
| *A44B 13/00* | (2006.01) |
| *A44B 11/25* | (2006.01) |
| *A44B 19/00* | (2006.01) |
| *A44B 18/00* | (2006.01) |

(52) U.S. Cl.

CPC ..... *A47C 21/026* (2013.01); *A44B 11/25* (2013.01); *A44B 13/00* (2013.01); *A44B 17/0041* (2013.01); *A44B 18/00* (2013.01); *A44B 19/00* (2013.01)

(58) Field of Classification Search

CPC ..... A47C 27/08

USPC ..... 5/690, 691, 692, 499

See application file for complete search history.

(56) References Cited

U.S. PATENT DOCUMENTS

| | | | | |
|---|---|---|---|---|
| 805,330 | A | 11/1905 | Tompkins | |
| 3,822,426 | A | 7/1974 | Mistarz | |
| 4,428,852 | A * | 1/1984 | Covington, Jr. ..... | C01G 37/027 252/62.51 C |
| 4,809,375 | A | 3/1989 | Bull | |
| 6,163,907 | A | 12/2000 | Larson | |
| 6,687,935 | B2 | 2/2004 | Reeder et al. | |
| 8,856,985 | B2 | 10/2014 | Rensink et al. | |
| 2004/0255387 | A1 | 12/2004 | England | |
| 2007/0245495 | A1 * | 10/2007 | Wang ..... | A47C 21/022 5/706 |

* cited by examiner

*Primary Examiner* — Fredrick C Conley

(74) *Attorney, Agent, or Firm* — Michael J. Feigin, Esq.; Feigin and Fridman LLC

(57) ABSTRACT

Two mattresses, of a same a different depth, share a same length and width. Each is in a shape of a rectangular prism and when placed one on top of the other, a larger rectangular prism is created. In order to hold the two mattresses in place when used together, a connector or connectors emanating from the sides or corners of each mattress are used. Such connectors can include hoop and loop fasteners, rings, hooks, lengths of fabric, and any combination thereof which hold the mattresses together in a taut manner.

20 Claims, 13 Drawing Sheets

DOUBLE MATTRESS CONNECTING SYSTEM

FIELD OF THE DISCLOSED TECHNOLOGY

The disclosed technology relates to mattresses, and more specifically, to mattresses which are connected together to form larger rectangular prism mattresses.

SUMMARY OF THE DISCLOSED TECHNOLOGY

A two part mattress of embodiments of the disclosed technology is made up of top mattress and bottom mattress of same or different heights (depths). Each mattress has an identical or substantially identically sized top side and bottom side to each other (identical length and width). A first connector is permanently affixed to the mattress, such as at a corner which joins the top and middle, or bottom and middle sides of the mattress. The first connector can also or instead be connected along a middle side of the mattress. A second connector is permanently affixed likewise, but to the bottom mattress at a corner and/or middle side thereof. The connectors are adapted to be removably connected to each other such that the top and bottom mattresses are held in place into one larger mattress (forming a larger rectangular prism).

Where directional labels are used, this is based on a typical way or convention in which mattresses is used. That is, a "top" direction or side is the one which, during ordinary use, faces upwards or is the furthest away from the ground or direction of the pull of gravity. A "bottom" direction or side is the opposite side thereof which is closest to the ground. A middle or lateral side is a side between and connecting the top and bottom sides thereof. "Middle" and "lateral" are used interchangeably in this disclosure and substantially vertical sides and/or extend a length of a depth along an outer edge of a mattress. "Depth" refers to a direction between top and bottom sides. Further, there are "corners" which is defined as the point where two sides (e.g. top and lateral sides; lateral and bottom sides) intersect. When an element "extends from a corner" it should be understood to be removably or irremovably attached substantially at and/or exactly at a corner. "Removable" is defined as "designed to be connected and reconnected at least 100 or more times without causing structural damage or physical changes to devices which are connected and reconnected as such." "Irremovably" is defined as "designed such that physical destruction or threads, a material, or the like or changes to structural integrity are required to disconnect."

In some embodiments, the top mattress has a smaller area than the bottom mattress. In some embodiments, the first connector is a first strip of hook and loop fastener which is connected to the top mattress at an extreme end of the strip and freely falls over the bottom mattress. The second connector is a second strip of hook and loop fastener in some such embodiments. When the phrase "end of" or "extreme end" of is used, it should be understood as (defined as) a portion of a device which, when measured along it's longest elongated length, is a portion thereof which is at a position, line segment, or point which is no more than 10% of a total distance of the longest elongated length from an edge or end point of the longest elongated length.

In other embodiments, two strips in one, two, or each middle side of the mattress can be used each with either a hook and loop fastener or another sort of fastener. In yet other embodiments, the strips extend along a majority of a length of one of the middle sides. Multiple such strips can be used, e.g. one on each of two sides or each of the four sides. Such strips of fabric can, when disconnected from a lower mattress or connector thereof, drape over middle side(s) of the lower mattress. The second connector in such cases can be a length of hook and loop fastener (known in the industry as "Velcro") which is affixed to middle sides of the lower mattress. Such hook and loop fastener can circumscribe (extend completely around and uninterrupted) the lower mattress and be the second connector described above.

In still further embodiments of the disclosed technology, snap connectors can be used at the end of one or two lengths of fabric with further snap connectors affixed directly the middle side of a mattress. At an end of a length of fabric, rather than using snap connectors one can also use any one or combination of: hooks, closed circular rings, pronged connectors, receptacles for pronged connectors, upper zipper teeth, and lower zipper teeth. In some embodiments, a ring is attached to a looped length of fabric and a second connector is a length of fabric with two spaced apart hook and loop fasteners. The hook and loop fasteners attach to each other such that a part of the length of fabric therebetween is in contact and held by the ring, keeping the length of fabric taut (pulled tightly without slack).

Described another way, a top and bottom mattress combination have a top mattress and a bottom mattress shaped as a rectangular prism. Connectors on a side of each top mattress and bottom mattress, when connected, cause the top mattress and the bottom mattress to join together and create a combined rectangular prism. The connectors removably join the top mattress and the bottom mattress together.

The connectors are each a ring attached to a fabric loop which is permanently attached to a respective mattress in embodiments of the disclosed technology. An additional piece of fabric is wrapped around the ring of each of the connectors and holds each said fabric loop taut in some embodiments. A first connector of the connectors is a combination of fabric connected at only one end to the top mattress or the bottom mattress, and a fastening mechanism at an opposite end to attach a second connector. The fabric can extend the entirety of a length of at least one lateral side (that is, the length of a front, back, left, or right side) of a mattress. Such fabric can be on each lateral side and be at a length such that the fastening mechanisms of the upper and lower mattress are at corresponding heights.

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

Two mattresses, of a same a different depth, share a same length and width. Each is in a shape of a rectangular prism and when placed one on top of the other, a larger rectangular prism is created. In order to hold the two mattresses in place when used together, a connector or connectors emanating from the sides or corners of each mattress are used. Such connectors can include hoop and loop fasteners, rings, hooks, lengths of fabric, and any combination thereof which hold the mattresses together in a taut manner.

Embodiments of the disclosed technology will become more clear in view of the following description of the figures.

Figure 1:
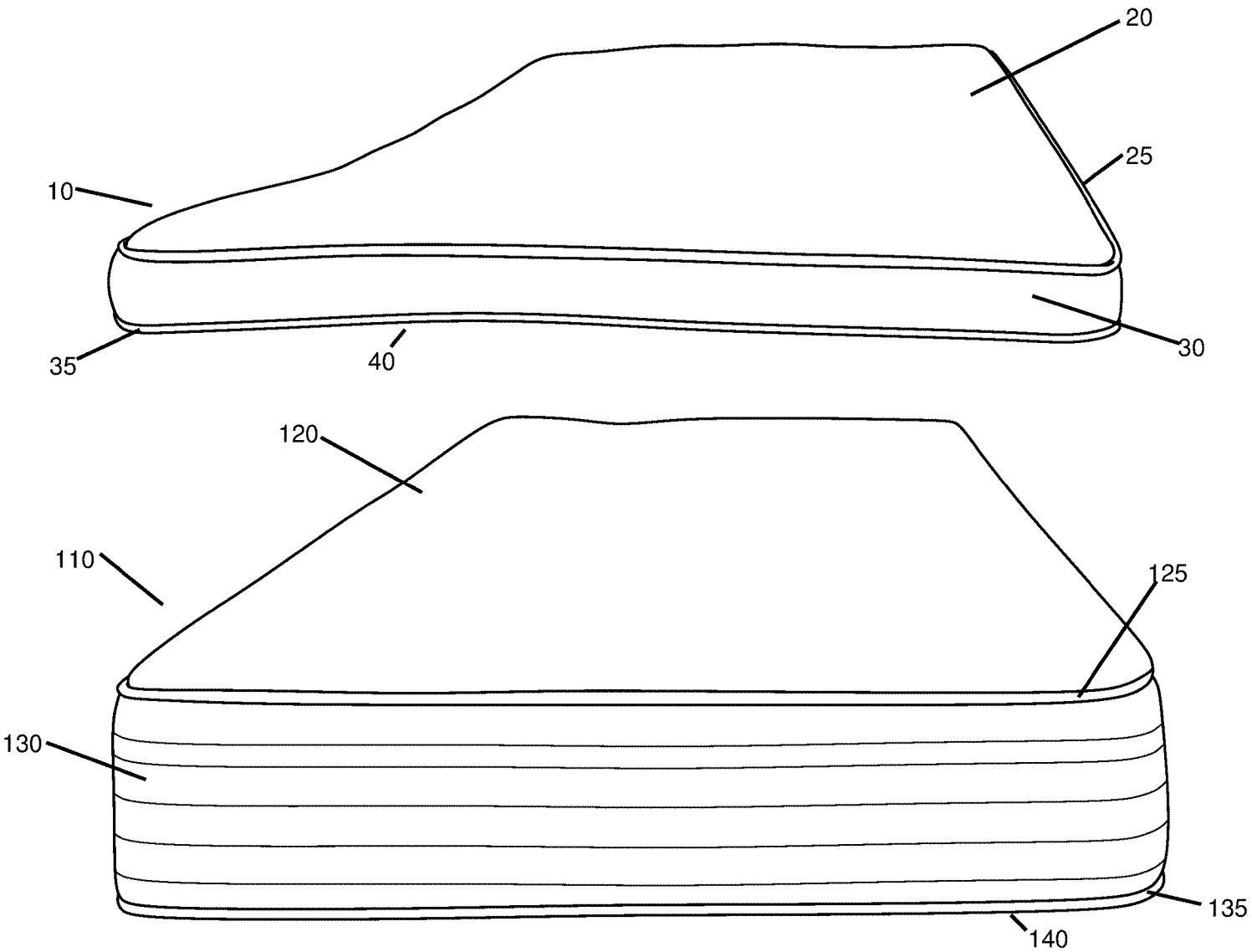
FIG. 1 shows a top and bottom mattress used in embodiments of the disclosed technology.

FIG. 1 shows a top and bottom mattress used in embodiments of the disclosed technology. Here, a top mattress 10 is shown with a top side 20, bottom side 40, and lateral or middle sides 30. There is a top corner 25 which extends between the top side 20 and lateral side 30 as well as a bottom corner 35 which extends between the lateral side 30 and bottom side 40. The "corners" are where the two sides join or within 10% of a distance from such a point of joining to an opposite top or bottom side the mattress. The corner can at a precise 90 degree angle and/or can have an extending or protruding lip of fabric such as shown in the figure. The lateral or middle sides 30 include a front side, rear side opposite the front side, and left and right sides. Each described "side" or portion of the middle or lateral side 30 extends in a most elongated length at a 90 or 180 degree angle from one another. Elements of the bottom mattress are the same as those of the top mattress and the labels have been incremented by 100 for ease of reading. Thus, the bottom mattress 110 has a top side 120, bottom side 140, lateral sides 130, and corners 125 and 135. The two mattresses used in embodiments of the disclosed technology can be of different depths (e.g. as shown in FIG. 1) or be of the same depth (e.g. using two of mattress 10 or two of mattress 110). The two mattresses can be rectangular prism shaped and the two mattresses together can form a larger rectangular prism with respective bottom side 40 and top side 120 parallel with each other and substantially touching each other.

FIG. 1 shows the mattresses themselves without the connectors. The foregoing figures show various connectors attached to one or both of these mattresses 10 or 110.

Figure 2A:
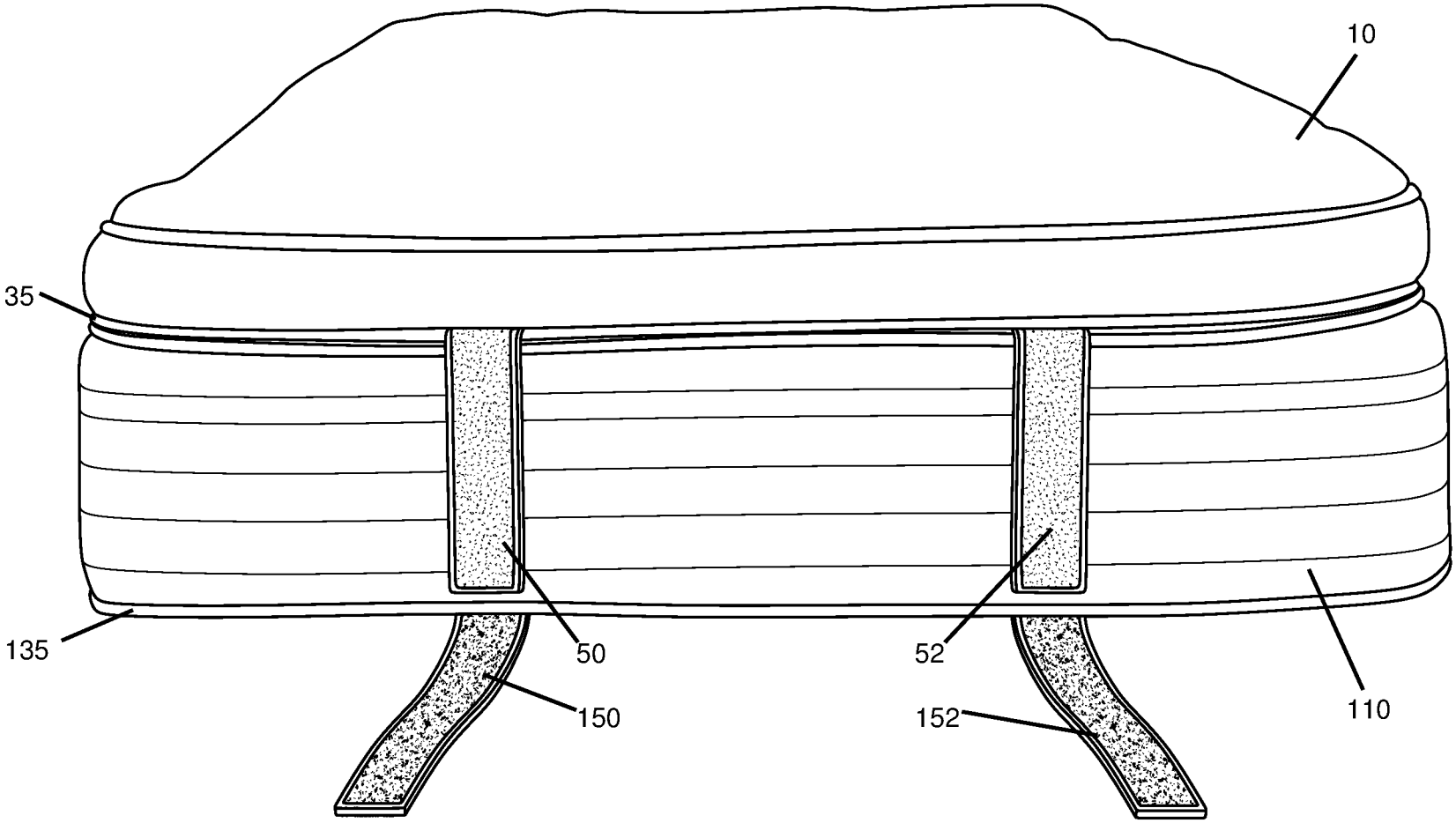
FIG. 2A shows a top and bottom mattress with a hook and loop length of connector extending from a corner of each of the top and bottom mattresses in an embodiment of the disclosed technology.

FIG. 2A shows a top and bottom mattress with a hook and loop length of connector extending from a corner of each of the top and bottom mattresses in an embodiment of the disclosed technology. Here the connectors include two lengths of fabric 50 and 52 with hook and loop fastening material. The connectors 50 and 52 are attached at a first extreme end to the top mattress 10, such as at the top corner 35 and can fall by gravity over the lateral side 130 of the bottom mattress 120. Corresponding lengths of fabric 150 and 152 are attached, in this embodiment, to the bottom mattress 110 at a corner 135, for example. The lengths of fabric and/or hoop and look fastening devices are attached at one extreme end and otherwise fall freely except when connected to each other in a removable way. Note that part or all of the connectors shown in the figures and/or disclosed herein are permanently or irremovably attached to a mattress and removably attach to another connector.

Figure 2B:
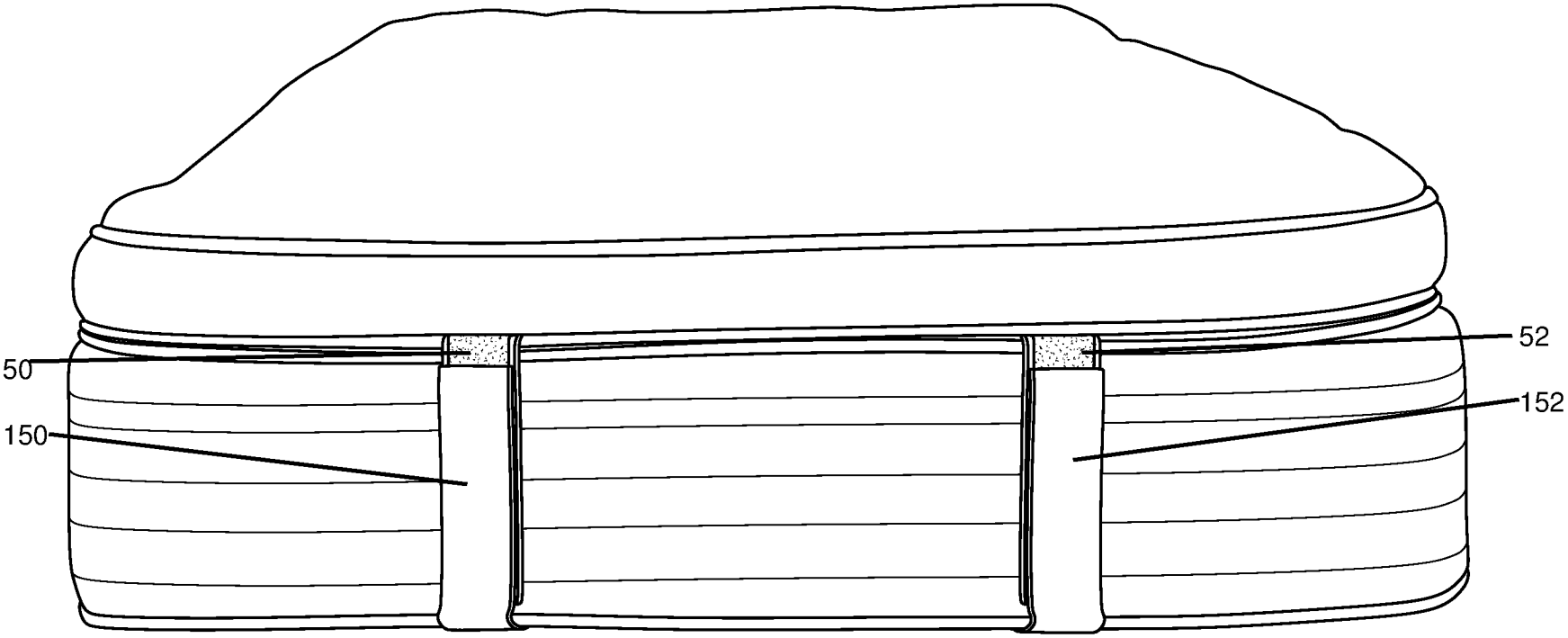
FIG. 2B shows the top and bottom mattress of FIG. 2A with the connectors attached to each other in an embodiment of the disclosed technology.

FIG. 2B shows the top and bottom mattress of FIG. 2A with the connectors attached to each other in an embodiment of the disclosed technology. Here, the lengths of fabric 50 and 150 are fastened together by hook and loop connectors as are the lengths of fabric 52 and 152 along a majority or substantially all of a length thereof. Note that one or two such groups of connectors (e.g. connector 50 and 150) can be found one lateral side, two opposite lateral sides, or all lateral sides of the mattress as can any of the connectors described or shown in this disclosure, unless specifically specified otherwise.

Figure 3A:
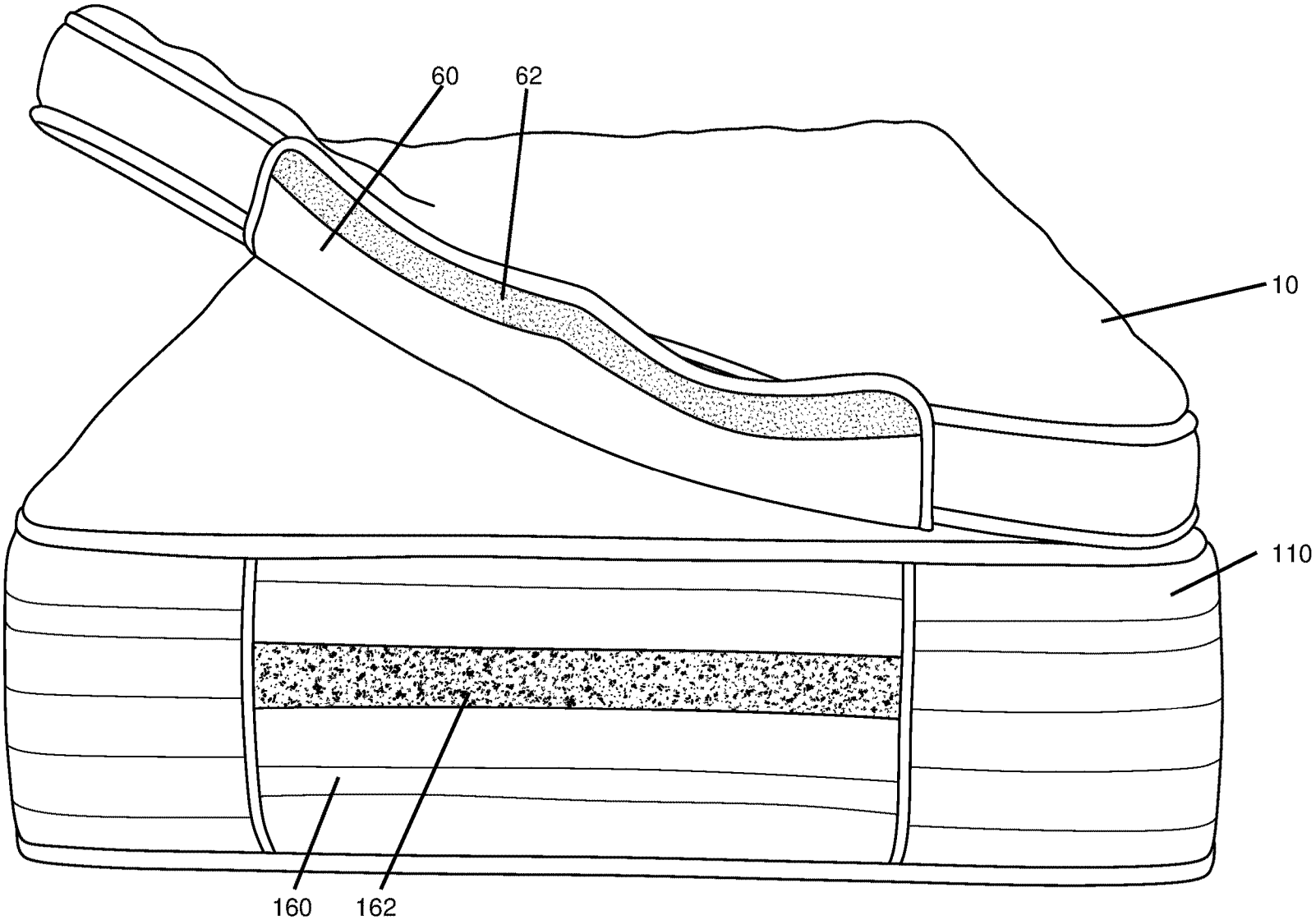
FIG. 3A shows a top and bottom mattress with connectors in a form of a length of material extending along a majority of one lateral side of a mattress in an embodiment of the disclosed technology.

FIG. 3A shows a top and bottom mattress with connectors in a form of a length of material extending along a majority of one lateral side of a mattress in an embodiment of the disclosed technology. Here there is a single fabric length of material 60 on one or more lateral sides 30 of the top mattress 10. At an edge thereof is a length of hook and loop fastener 62 which extends a majority of, substantially all of, or all of a lateral length of the fabric 60. The fabric 60 hangs down over at least a part of a lower mattress 110 at the side 130 thereof. The lower mattress 110 has a corresponding length of fasteners, such as hook and loop connectors 162 on a connecting region 160.

Figure 3B:
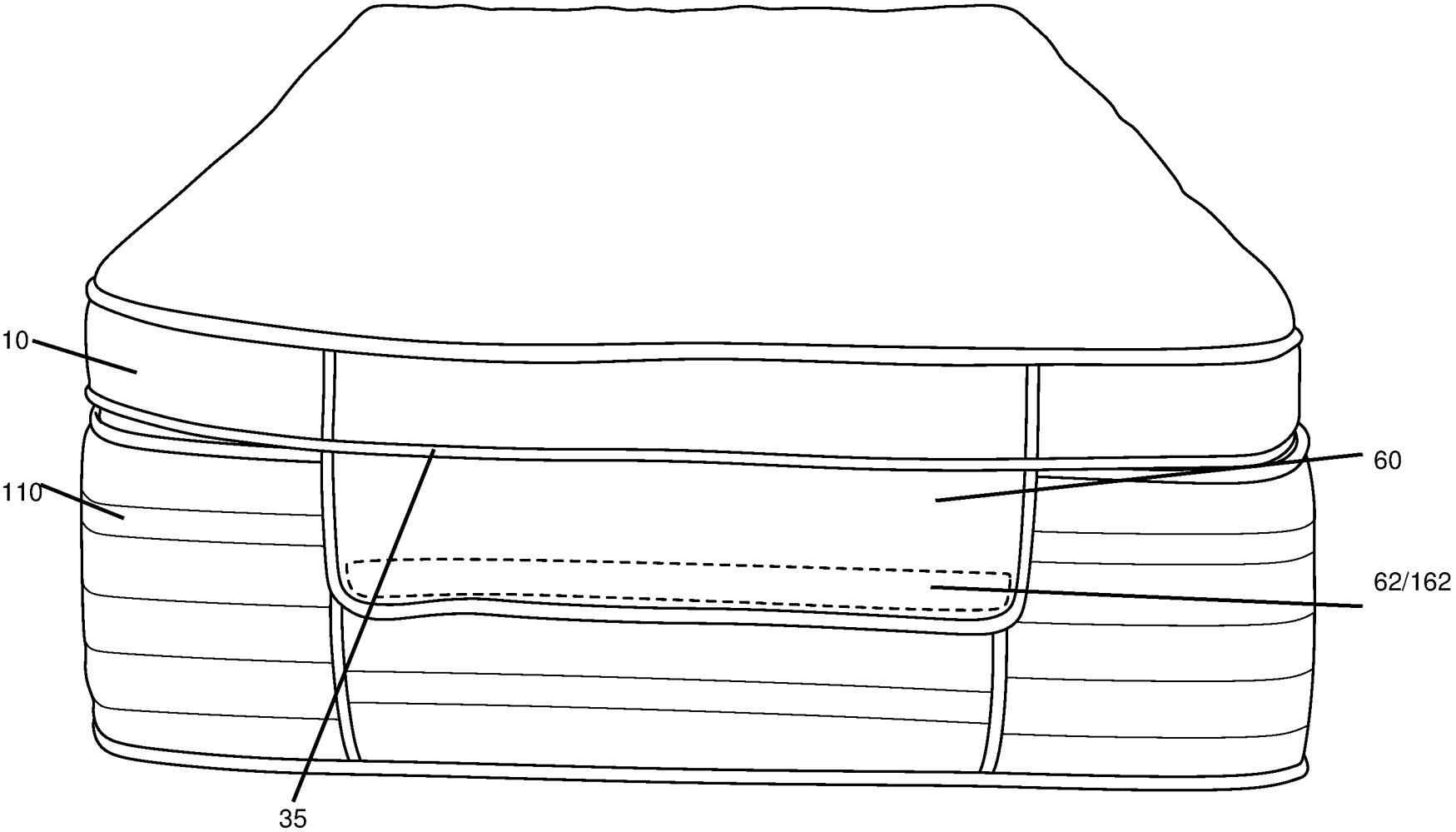
FIG. 3B shows the top and bottom mattress of FIG. 3A with the length of material attaching the mattresses together in an embodiment of the disclosed technology.

FIG. 3B shows the top and bottom mattress of FIG. 3A with the length of material attaching the mattresses together in an embodiment of the disclosed technology. The flap of fabric 60 is now connected to the hook and loop fastener 162 by way of it's own hook and loop fastener 62. Note that any sort of fastener can be used in place the hook and loop fastener shown, connecting a flap 60 which extends a majority of a length of one side of a mattress and connected at the corner 25 or side 30 to another fastening mechanism there—aligned with an end of the fabric, e.g. a lower end when the fabric is let to fall freely from the mattress 10.

Figure 3C:
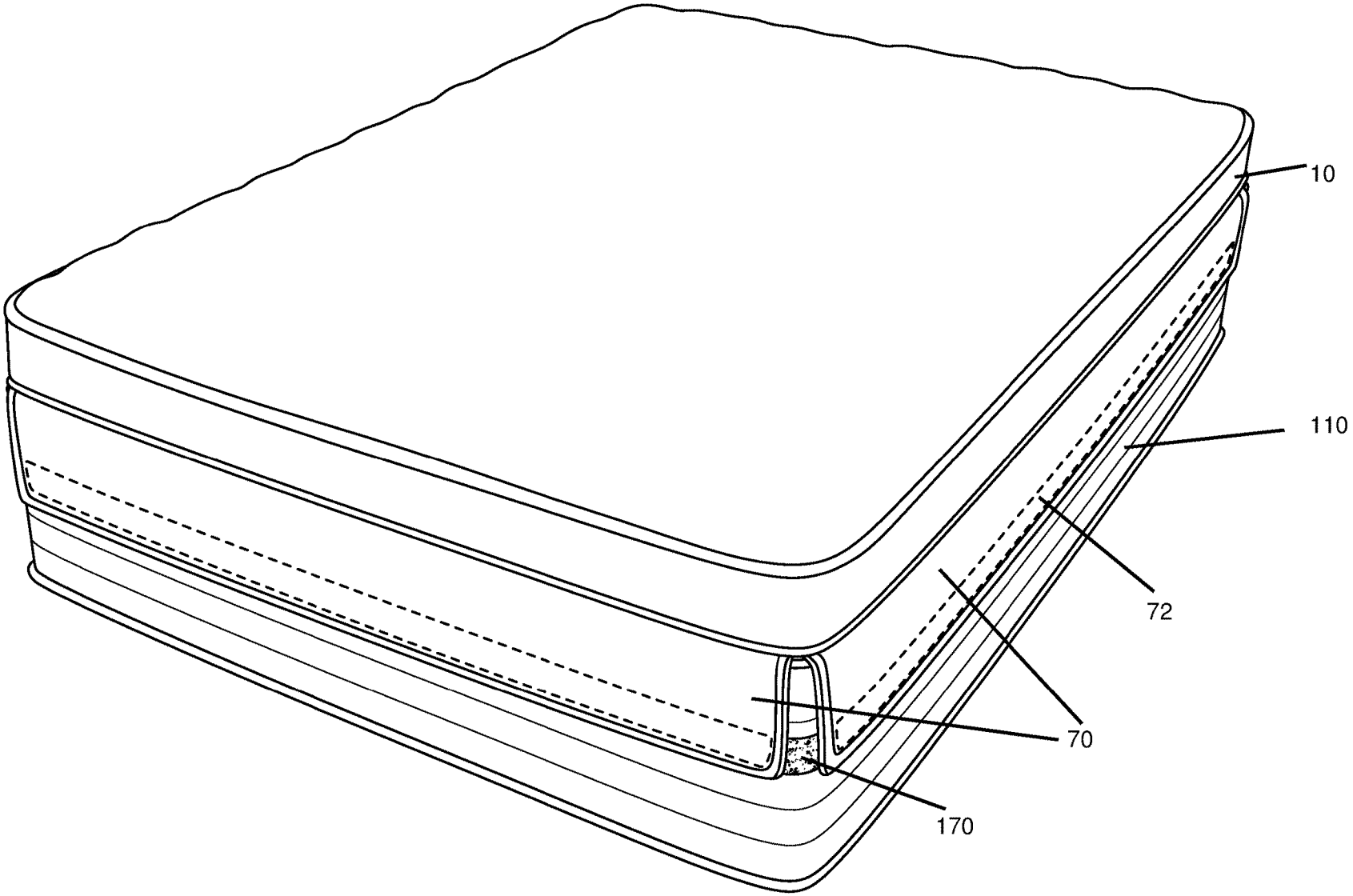
FIG. 3C shows a top and bottom mattress with a length of fabric along each side of the top mattress which is connected to a circumferentially situated length of hook and loop fastener on lateral sides of a lower mattress in an embodiment of the disclosed technology.

FIG. 3C shows a top and bottom mattress with a length of fabric along each side of the top mattress which is connected to a circumstantially situated length of hook and loop fastener on lateral sides of a lower mattress in an embodiment of the disclosed technology. This embodiment functions in similar ways to that shown with the fabric 60, except the fabric 70 extends along an entirety or substantially an entirety of a lateral length of at least one, two, or all lateral sides 30 of the top mattress 10. It further includes a connector or fastening device 72, such as hook and loop fastener which can attach to a connector of fastener 170 which extends around the lower mattress 110.

Figure 3D:
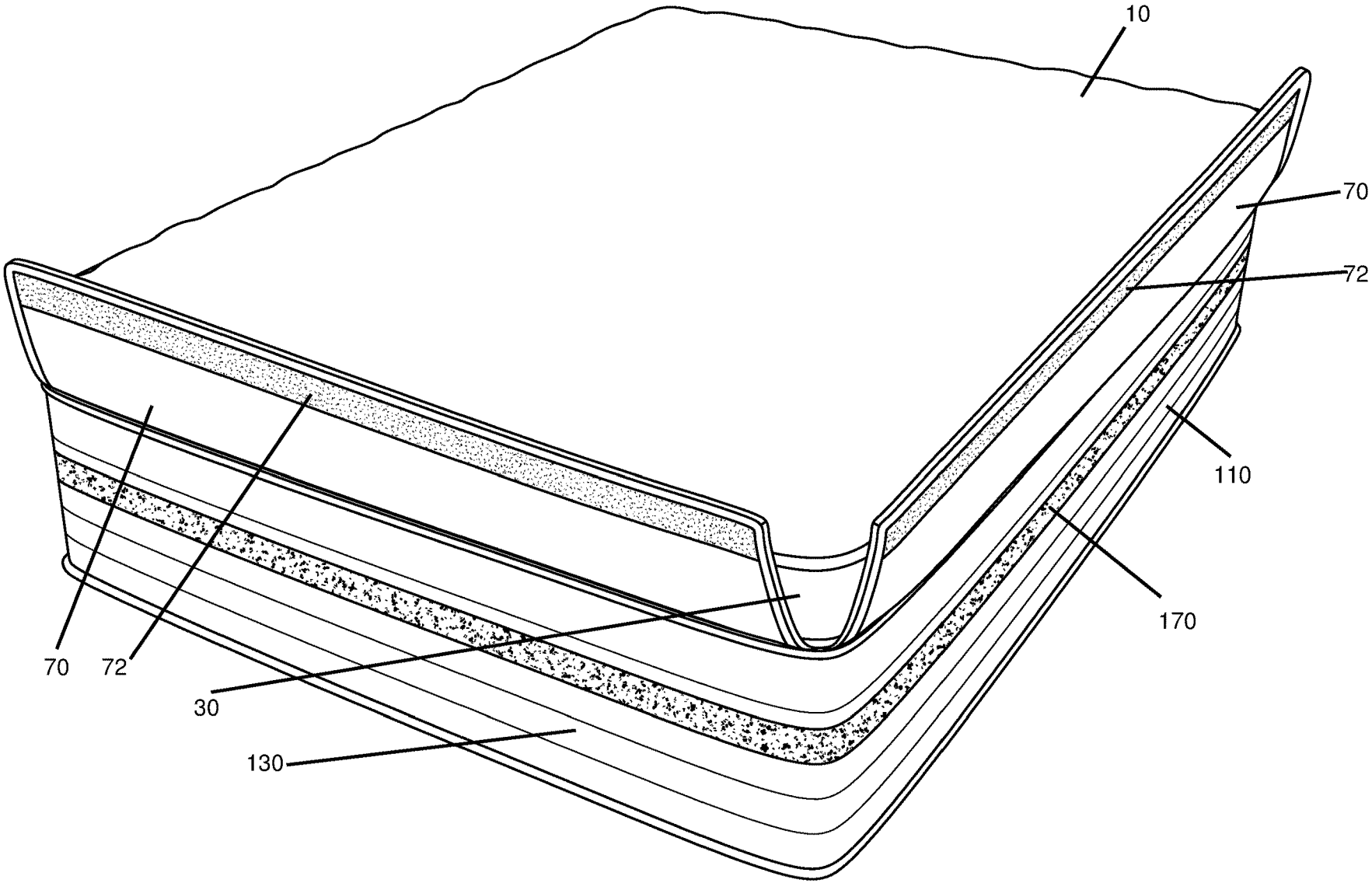
FIG. 3D shows the top and bottom mattress of FIG. 3C with the length of fabric along each side raised to show the hook and loop fastener extending around the perimeter of the lower mattress is an embodiment of the disclosed technology.

FIG. 3D shows the top and bottom mattress of FIG. 3C with the length of fabric along each side raised to show the hook and loop fastener extending around the perimeter of the lower mattress is an embodiment of the disclosed technology. Here the fabric flaps 70 have been raised/rotated upwards (against the pull of gravity) to show the fastening mechanism 72, hook and loop fastener on each flap 70. Note that the fastening mechanism 170 of the lower mattress 110 extends circumstantially or completely around the lower mattress at a discrete height in some versions of this embodiment of the disclosed technology. The figures shown can be said to be mirror images of the opposite views—that is, FIG. 3D can be said to show a front and right side of the mattresses or a back and left side simultaneously as the figures would look identical or like mirror images thereof. This is also true of FIG. 1 which can be said to be a view from the top and side or bottom and reverse side.

Figure 4B:
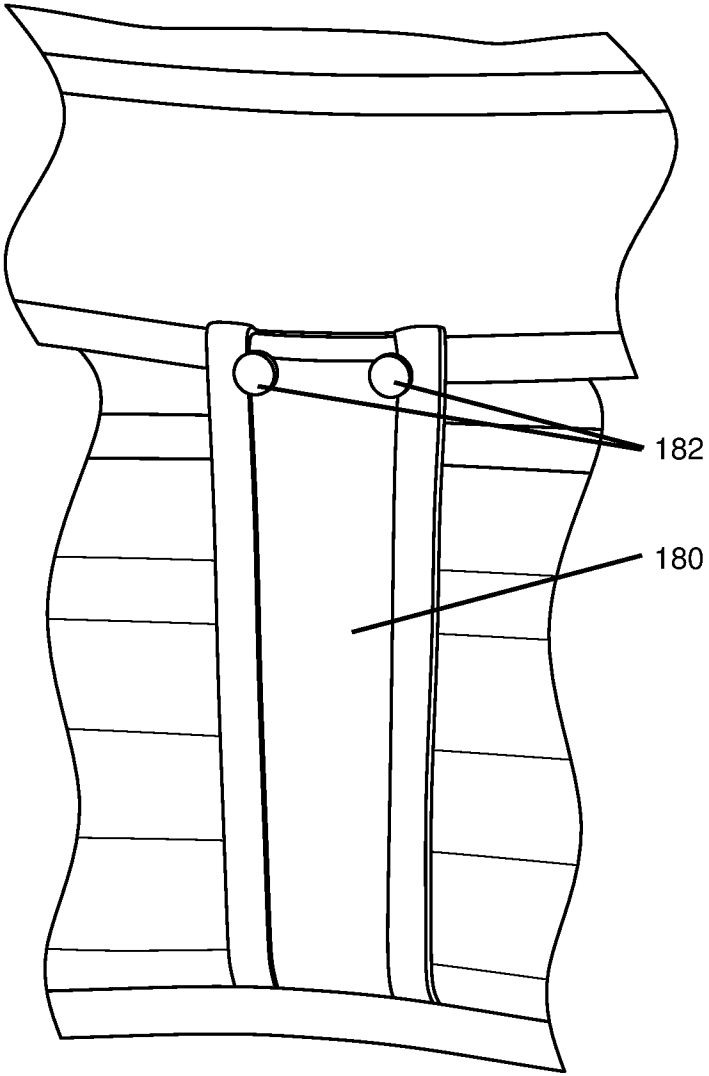
FIG. 4B shows a version of the insert of FIG. 4A with the snaps of the length of fabric attached to snaps on a lateral side of the upper mattress in an embodiment of the disclosed technology.
Figure 4A:
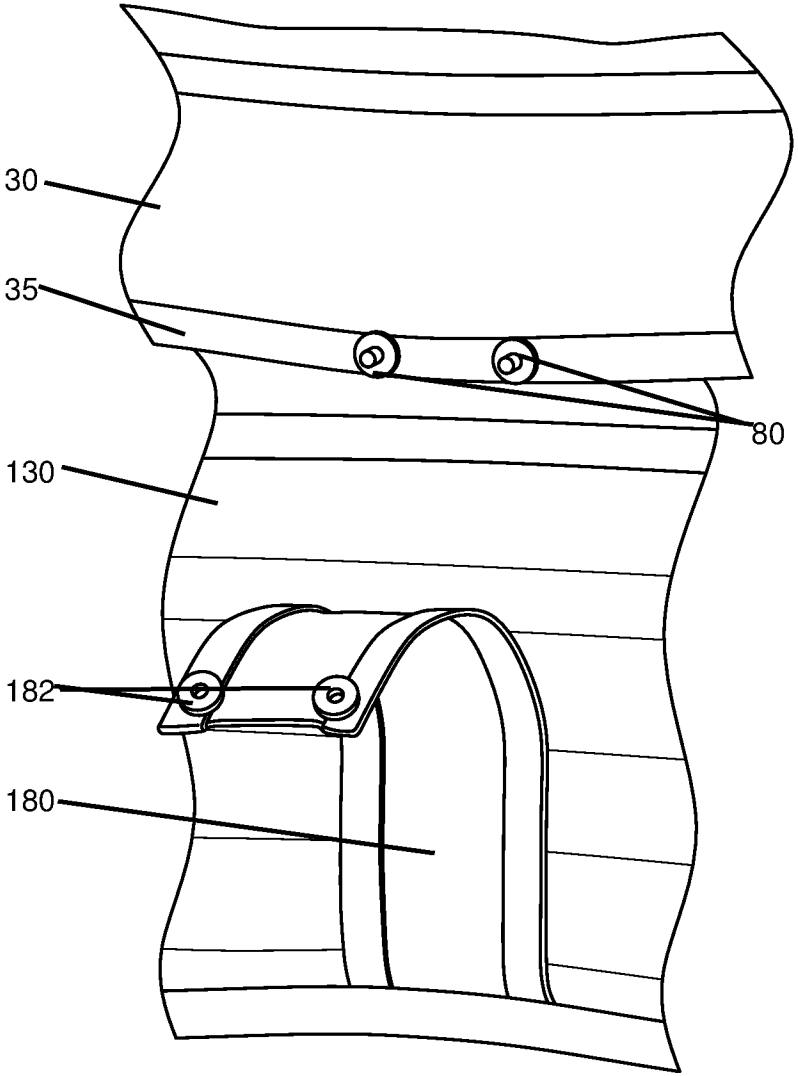
FIG. 4A shows an inset of a version of the side of the top and bottom mattress of FIG. 1 with an additional length of fabric with snaps at an extreme end thereof fixedly connected to the lower mattress in an embodiment of the disclosed technology.

FIG. 4A shows an inset of a version of the side of the top and bottom mattress of FIG. 1 with an additional length of fabric with snaps at an extreme end thereof fixedly connected to the lower mattress in an embodiment of the disclosed technology. Here, on the middle side 30 or a corner 35 of the top mattress 10 are one or a plurality of snap fasteners 80. Corresponding snap fasteners 182 are at an end of a length of fabric 180 which is attached to a side 130 and/or bottom corner of the bottom mattress 180. The fabric 180 is connected at one end of an elongated length thereof and disconnected or unconnected from the mattress 110 at another end thereof.

FIG. 4B shows a version of the insert of FIG. 4A with the snaps of the length of fabric attached to snaps on a lateral side of the upper mattress in an embodiment of the disclosed technology. Here the snaps 182 are connected to the snap fastener 80 such that the fabric 180 is held taught and holds the mattresses together in place and/or provides at least some additional resistance to the mattresses 10 and 110 moving relative to one another in at least three cardinal directions. Multiple lengths of fabric 180 and corresponding parts can be used on a lateral side 30/130 or more than one lateral side 30/130 of the mattresses to prevent movement of one mattress relative to the other.

With regards to the remaining embodiments, the structural changes from prior embodiments are being described below. Those pars which work or function as described with regards to previous embodiments should be presumed to also apply to the below embodiments.

Figure 5B:
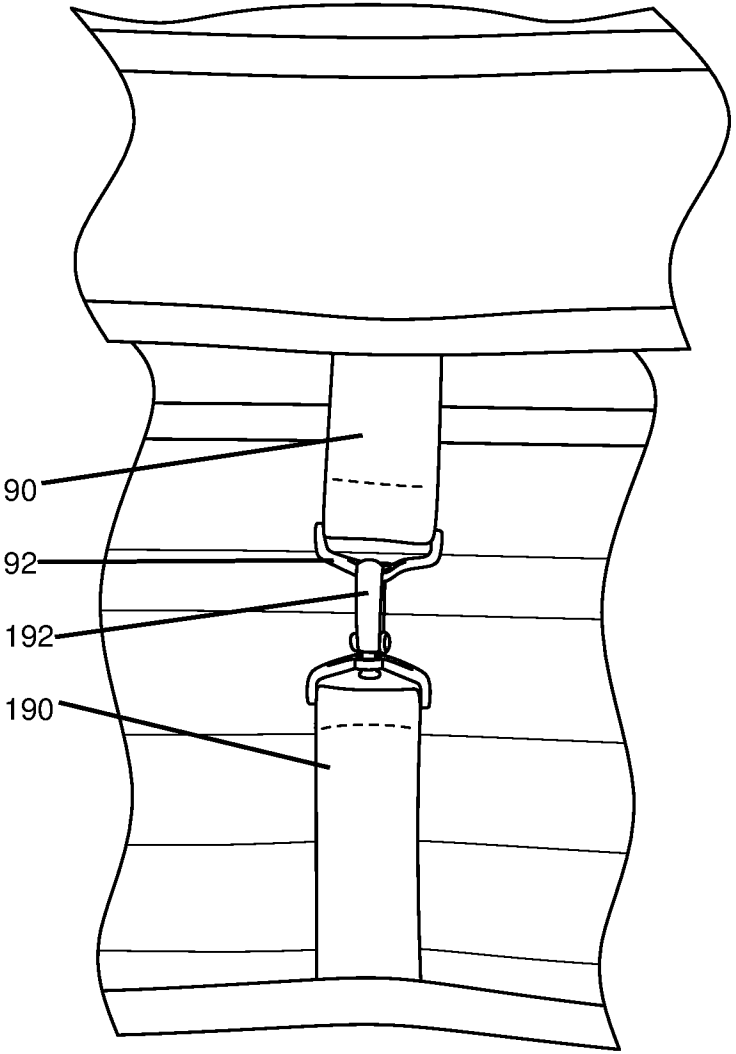
FIG. 5B shows a version of the inset of FIG. 5A with the ring and hook connected to each other in an embodiment of the disclosed technology.
Figure 5A:
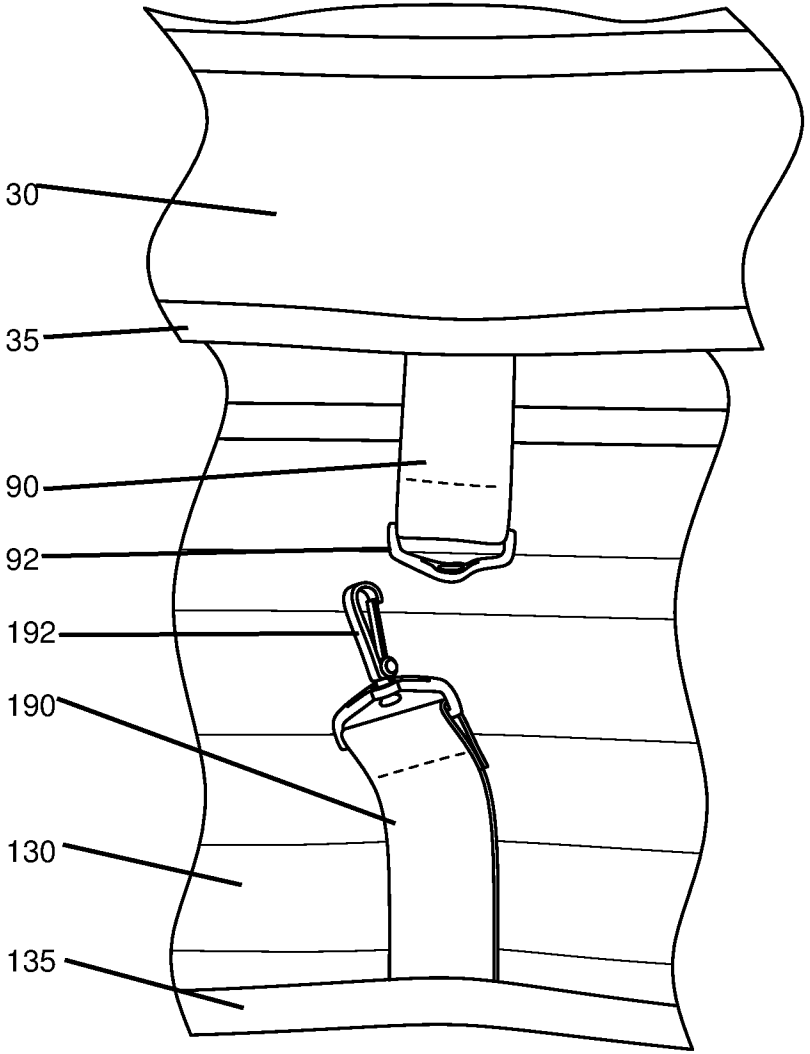
FIG. 5A shows an inset of a version of a side of a top and bottom mattress of with two lengths of fabric extending from respective top and bottom mattresses and terminating in a respective ring and hook disconnected from each other in an embodiment of the disclosed technology.

FIG. 5A shows an inset of a version of a side of a top and bottom mattress of with two lengths of fabric extending from respective top and bottom mattresses and terminating in a respective ring and hook disconnected from each other in an embodiment of the disclosed technology. FIG. 5B shows a version of the inset of FIG. 5A with the ring and hook connected to each other in an embodiment of the disclosed technology. Here, the connectors are lengths of fabric 90 and 190 connected to the respective mattresses, each terminating, respectively, in a ring 92 or hook 192. The ring 90 and hook 192 removably connect to each other to hold the mattresses tight or taut against each other, as shown.

Figure 6B:
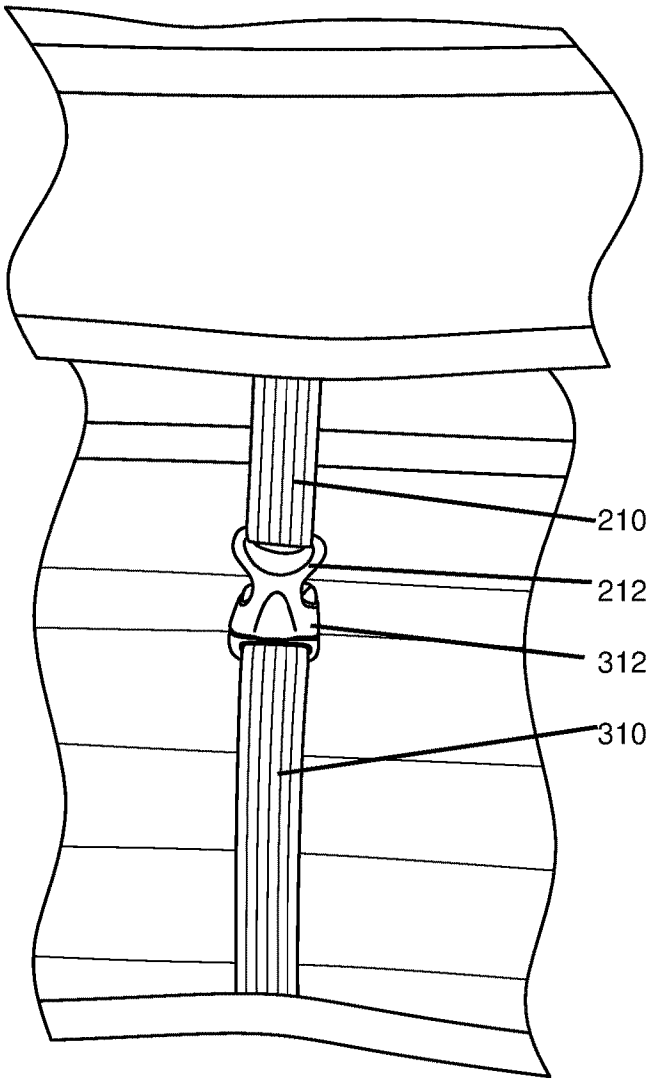
FIG. 6B shows a version of the inset of FIG. 6A with the prong connectors removably connected to each other in an embodiment of the disclosed technology.
Figure 6A:
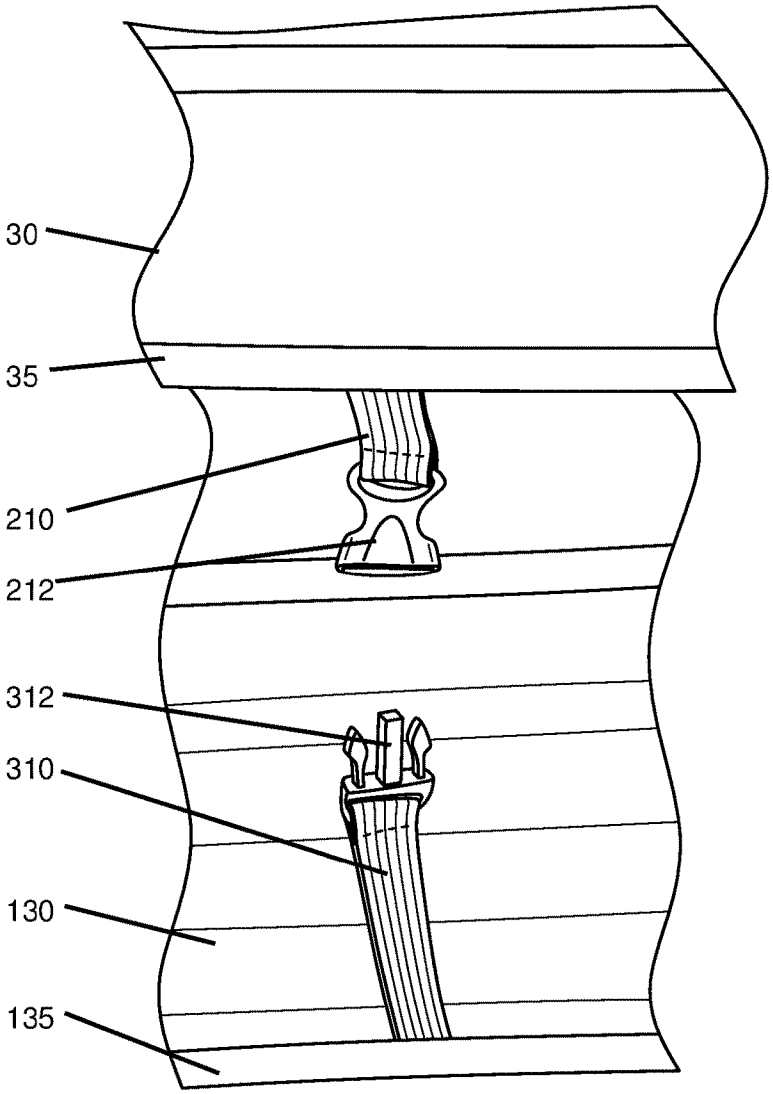
FIG. 6A shows an insert of a version of the side of the top and bottom mattress of FIG. 1 with prong connectors, disconnected from one another in an embodiment of the disclosed technology.

FIG. 6A shows an insert of a version of the side of the top and bottom mattress of FIG. 1 with prong connectors, disconnected from one another in an embodiment of the disclosed technology. FIG. 6B shows a version of the inset of FIG. 6A with the prong connectors removably connected to each other in an embodiment of the disclosed technology. Here the lengths of fabric 210 and 310 are elastic and when connected, as shown in FIG. 6B, create not only tautness but tension which pulls the mattresses towards each other. Connectors, such as pronged connectors 212 and 312 are used at the end of each length of fabric.

Figure 7B:
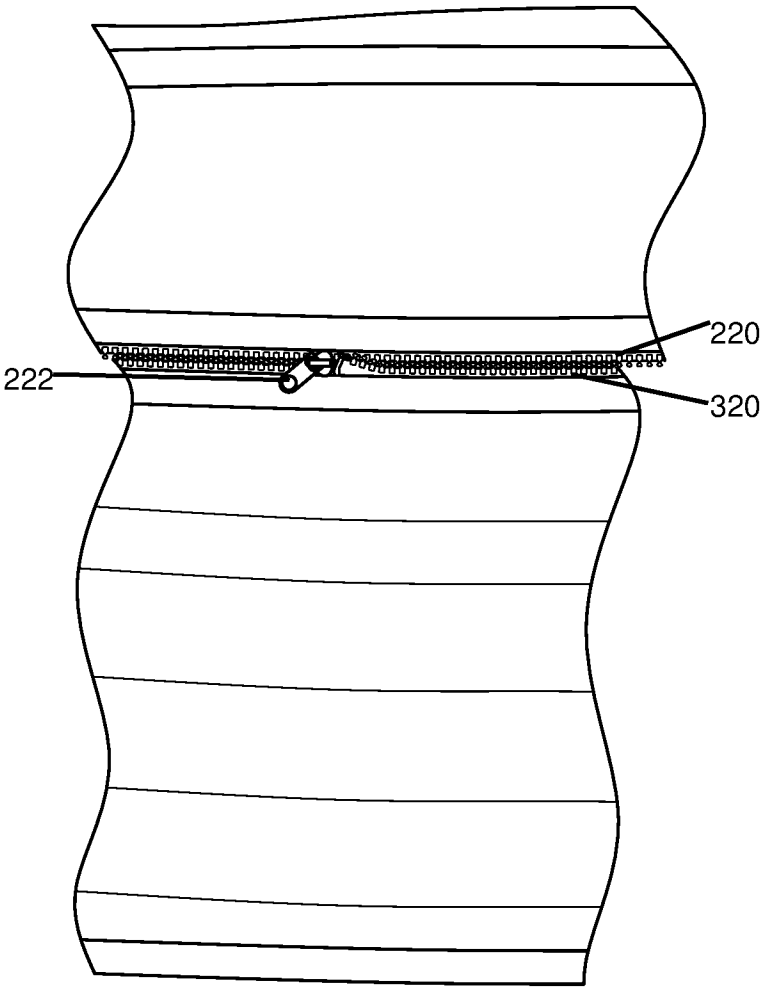
FIG. 7B shows a version of the inset of FIG. 7A with the upper and lower zipper teeth connected to each other in an embodiment of the disclosed technology.
Figure 7A:
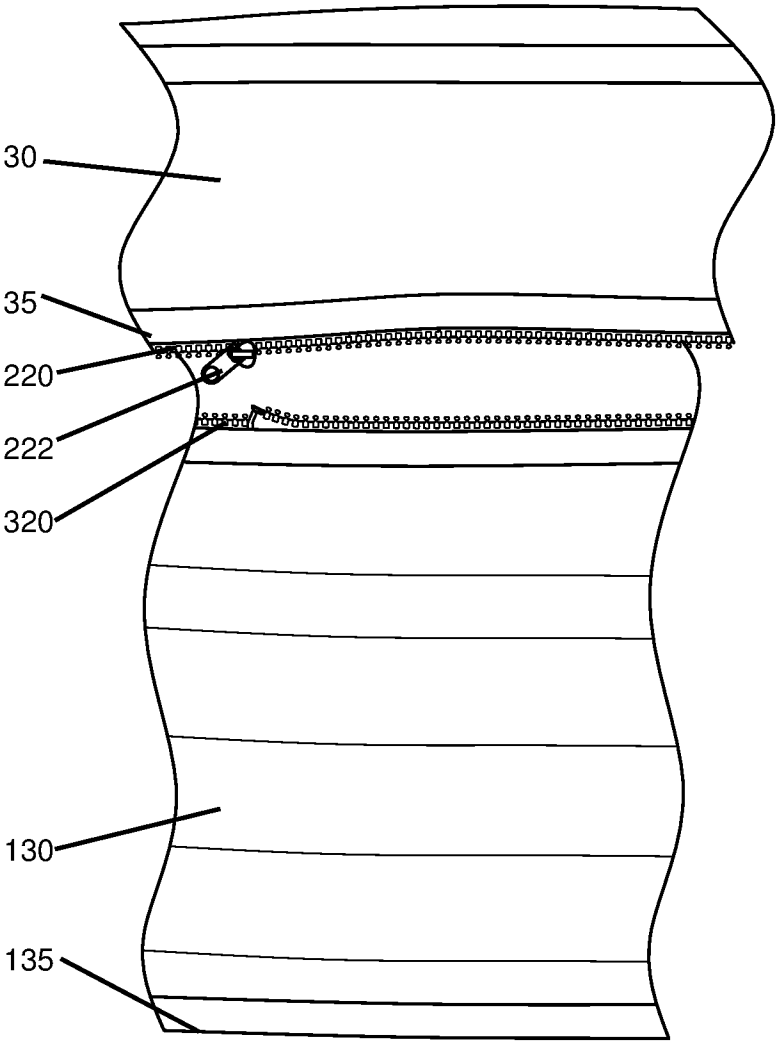
FIG. 7A shows an insert of a version of the side of the top and bottom mattress of FIG. 1 with a upper and lower zipper teeth disconnected from one another in an embodiment of the disclosed technology.

FIG. 7A shows an insert of a version of the side of the top and bottom mattress of FIG. 1 with a upper and lower zipper teeth disconnected from one another in an embodiment of the disclosed technology. FIG. 7B shows a version of the inset of FIG. 7A with the upper and lower zipper teeth connected to each other in an embodiment of the disclosed technology. The connectors here are zippers 220 and 320 with an upper zipper 220 and lower zipper 320 that removably connect to each other as shown in FIG. 7B. The respective upper and lower zippers are attached, in some embodiments of the disclosed technology, to corners 35 and 125 of the respective mattresses 10 and 110. A zipper head 222 is used to connect or disconnect the upper zipper 220 and lower zipper 320 from each other.

Figure 8B:
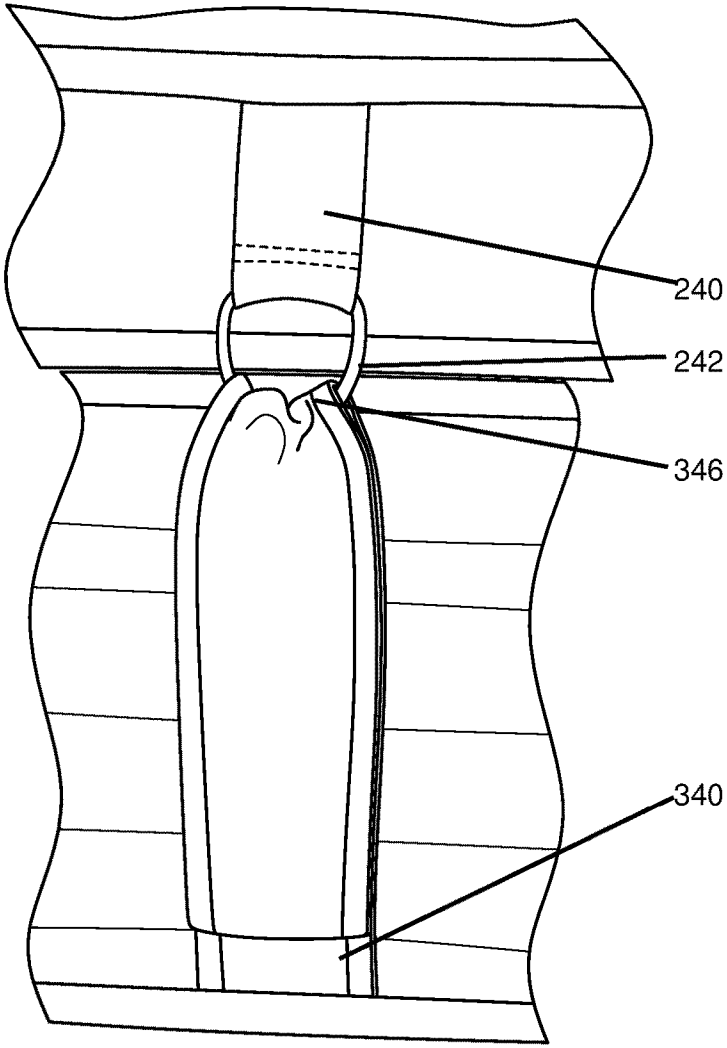
FIG. 8B shows a version of the inset of FIG. 8A with the ring on a fabric loop and length of fabric with spaced apart hook and loop fastener connected to each other in an embodiment of the disclosed technology.
Figure 8A:
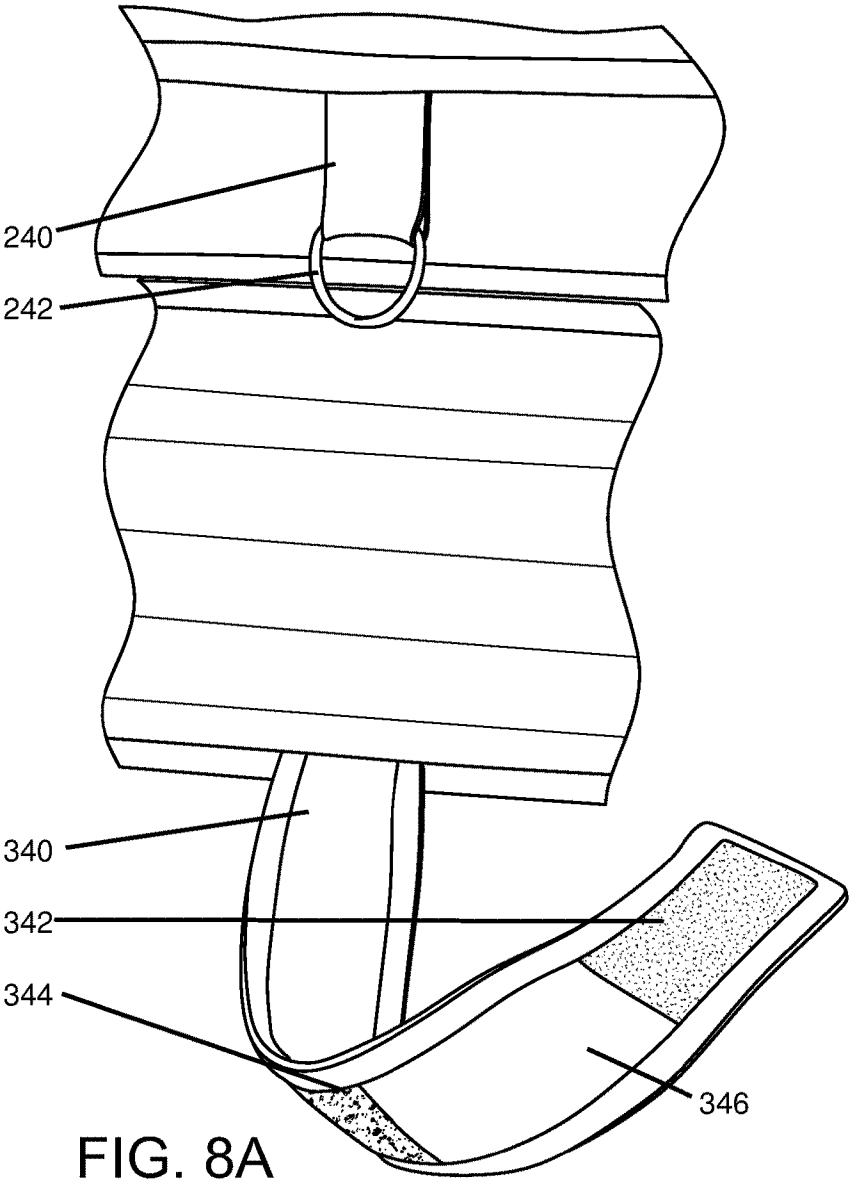
FIG. 8A shows an insert of a version of the side of the top and bottom mattress of FIG. 1 with a ring on a fabric loop disconnected from a length of fabric with spaced apart hook and loop fastener in an embodiment of the disclosed technology.

FIG. 8A shows an insert of a version of the side of the top and bottom mattress of FIG. 1 with a ring on a fabric loop disconnected from a length of fabric with spaced apart hook and loop fastener in an embodiment of the disclosed technology. FIG. 8B shows a version of the inset of FIG. 8A with the ring on a fabric loop and length of fabric with spaced apart hook and looper fastener connected to each other in an embodiment of the disclosed technology. Here, the length of fabric 340 has two hook and loop fastening sections 344 and 342 with a region between the fastening sections 346. The extreme end of the fabric 340, which is attached to the lower mattress, is slipped through a ring 242 which attached to a length of fabric and ultimately irremovably connected to the top mattress 10. The fabric 340 is then folded over itself such that the region between the fastening sections 346 is in contact with the ring 242 and then fastening sections 344 and 342 are attached to each other. Recall that the connectors (fabric 240 and 340, in this embodiment) are permanently attached to the mattresses at sides, corners, or tops/bottoms thereof while at another end thereof, the connectors are removably connected to each other.

Figure 9B:
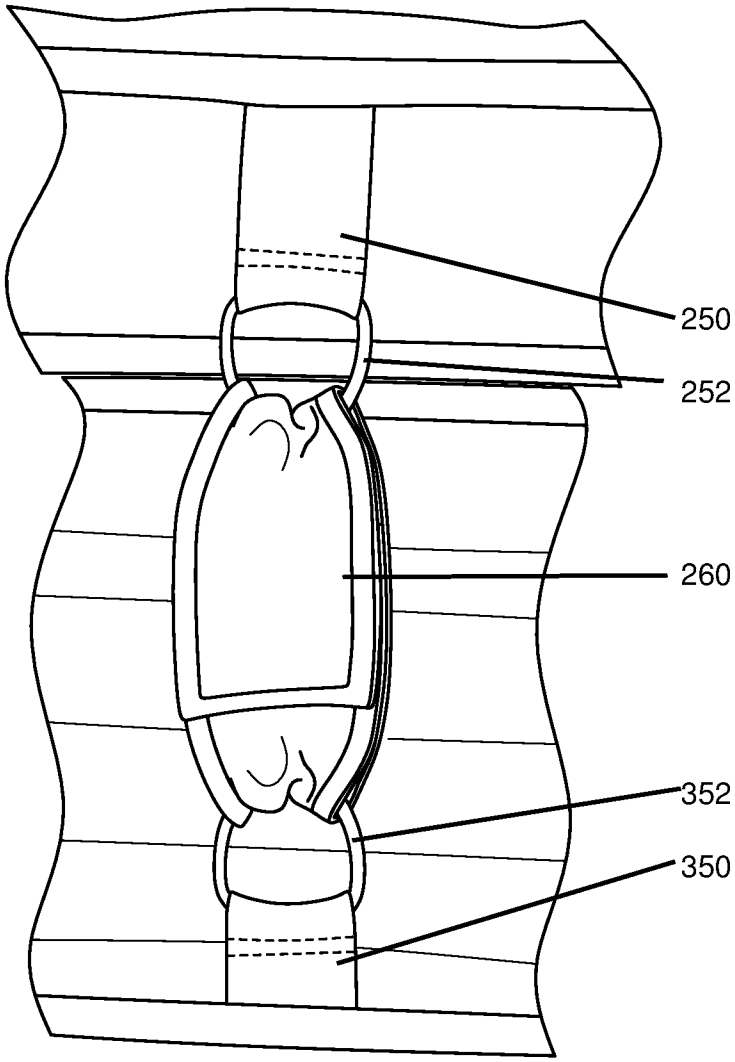
FIG. 9B shows a version of the inset of the top and bottom mattress of FIG. 1 with a removable length of fabric attaching the rings shown in FIG. 9A in an embodiment of the disclosed technology.
Figure 9A:
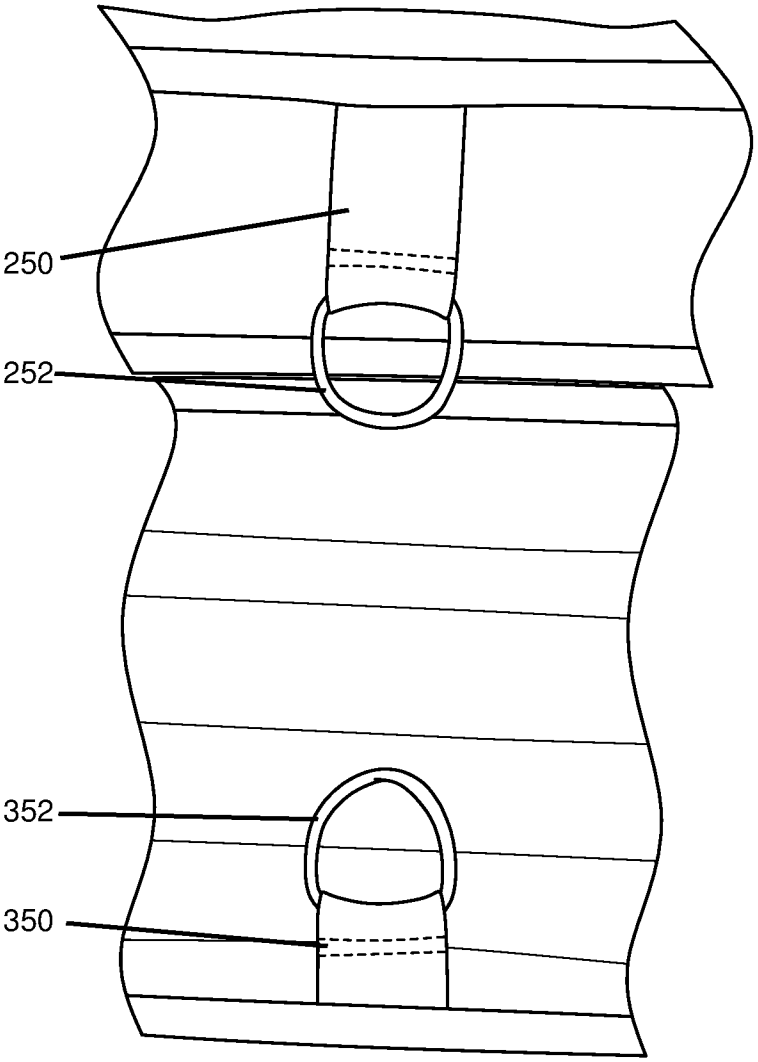
FIG. 9A shows an insert of a version of the side of the top and bottom mattress of FIG. 1 with a ring irremovably attached to each mattress by way of a fabric loop in an embodiment of the disclosed technology.

FIG. 9A shows an insert of a version of the side of the top and bottom mattress of FIG. 1 with a ring irremovably attached to each mattress by way of a fabric loop in an embodiment of the disclosed technology. FIG. 9B shows a version of the inset of the top and bottom mattress of FIG. 1 with a removable length of fabric attaching the rings shown in FIG. 9A in an embodiment of the disclosed technology. Here there are two rings 252 and 342 connected irremovably to lengths of fabric 250 and 350 respectively which, in turn, are irremovably connected to the respective mattresses 10 and 110 at corners and/or sides thereof. Another length of fabric 260 is passed through each ring 252 and 352 and is then attached to itself to hold the mattresses taught by way of the rings.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A two-part mattress, comprising:

a top mattress and a bottom mattress that are separate and distinct from each other, each said mattress including a top side, a bottom side, a middle side including a depth, an upper edge defining said top side, a lower edge defining said bottom side, wherein:

said middle side is disposed between said top side and said bottom side and circumscribed by said upper edge and said lower edge;

said depth of each mattress is larger than a depth of said upper edge and said lower edge of said respective mattress; and each respective top side and bottom side of each said mattress has an identical length and width to each other;

a first connector permanently affixed to said lower edge of said top mattress, said first connector extending continuously along said lower edge of said top mattress and including an opening at a corner of said top mattress;

a second connector permanently affixed to at least one of:

a) a corner between said top side or said bottom side and middle side of said bottom mattress;

b) a middle side of said bottom mattress;

wherein said first connector and said second connector connect to each other from said lower side of said top mattress and said upper side of said lower mattress such that said top mattress and said bottom mattress are held in place relative to each other.

2. The two-part mattress of claim 1, wherein said top mattress has a smaller area than said bottom mattress.

3. The two-part mattress of claim 1, wherein said first connector is a first strip of hook and loop fastener which is connected to said top mattress at an extreme end of said strip and freely falls over said bottom mattress and said second connector is a second strip of hook and loop fastener.

4. The two-part mattress of claim 3, wherein said first strip is at least two strips that are separate and distinct from each other and disposed on a same middle side of said top mattress, wherein the at least two strips are separated by a space and extend perpendicularly outwardly from the same middle side, wherein the at least two strips each include a length and a width of which the length is larger than the width.

5. The two-part mattress of claim 1, wherein said first connector comprises at least two elongated lengths of fabric, each said elongated length of fabric separate and distinct and separated by a space and extending across at a length which is a majority of a length of one of a left, right, front, or back portion of said middle side of said top mattress and which is adapted to hang over respective said second connectors of said bottom mattress.

6. The two-part mattress of claim 1, wherein said first connector comprises four elongated lengths of fabric, each of said four elongated lengths of fabric separate and distinct from one another and separated by a space and extending outwardly from an edge of a side of the top mattress and covering substantially an entirety of a left, right, front, or rear portion of said middle side and which is adapted to hang down from said top mattress over a respective said second connector of said bottom mattress.

7. The two-part mattress of claim 6, wherein said second connector comprises hook and loop fastener which circumscribes said middle side of said lower mattress.

8. The two-part mattress of claim 1, wherein said first connector comprises at least two first snap connectors and said second connector comprises a length of fabric which is at one end is attached to said second mattress and at another end comprises at least two second snap connectors such that said length of fabric covers from a bottom to a top edge of said middle side of said bottom mattress when said first snap connectors and said second snap connectors are removably connected to each other.

9. The two-part mattress of claim 1, wherein said first connector and said second connector each comprise a length of fabric extending from a respective said corner of respective said top and bottom mattresses, each said length of fabric terminating in a fastening apparatus.

10. The two-part mattress of claim 9, wherein each said fastening apparatus is different from one another and selected from the group consisting of hooks, closed circular rings, pronged connectors, receptacles for pronged connectors, upper zipper teeth, and lower zipper teeth.

11. The two-part mattress of claim 1, wherein said first connector is a ring attached to a looped length of fabric and said second connector is a length of fabric with two spaced apart hook and loop fasteners.

12. The two-part mattress of claim 11, wherein said two spaced apart hook and loops fasteners are removably attached to each other such that a portion of said length of fabric situated between said two spaced apart hook and loop fasteners is held taut by said ring.

13. A top and bottom mattress combination comprising:

a top mattress and a bottom mattress that are separate and distinct from each other and shaped as a rectangular prism, the top mattress and bottom mattress each including a depth that is larger than a depth of an edge of the respective mattress;

a first connector affixed to a lower edge of the top mattress and a second connector affixed to an upper edge of the bottom mattress, which, when connected, cause said top mattress and said bottom mattress to join together and create a combined rectangular prism;

wherein said first connector and said second connector removably connect to each other from a lower side of said top mattress and an upper side of said lower mattress such that said top mattress and said bottom mattress are held in place relative to each other.

14. The mattress combination of claim 13, wherein said connectors are each a ring attached to a fabric loop which is permanently attached to a respective said top or said bottom mattress.

15. The mattress combination of claim 14, wherein an additional piece of fabric is wrapped around said ring of each of said connectors and holds each said fabric loop taut.

16. The mattress combination of claim 13, wherein a first connector of said connectors is a combination of fabric connected at only one end to said top mattress or said bottom mattress comprising a fastening mechanism at an opposite end from said one end which is adapted to removably attached to a second connector of said connectors.

17. The mattress combination of claim 16, wherein said fastening mechanism is a hook and loop fastener and said fabric extends for substantially an entirety of a length of at least one lateral side said top or said bottom mattress.

18. The mattress combination of claim 17, wherein said fabric is multiple lengths of fabric, each being separate and distinct from one another and including a space between one another and extending over a different lateral side of said top mattress.

19. The mattress combination of claim 18, wherein a length of hook and loop fastener extends around an entirety of a perimeter of said bottom mattress.

20. The mattress combination of claim 19, wherein said hook and loop fastener of said bottom mattress is at a height corresponding with a height of said fastening mechanism of said top mattress.

* * * * *